US005501199A

United States Patent [19]

Yoneyama

[11] Patent Number: 5,501,199

[45] Date of Patent: Mar. 26, 1996

[54] MONITORING OF EVAPORATIVE PURGE SYSTEM

[75] Inventor: Shuichi Yoneyama, Kanagawa, Japan

[73] Assignee: Nissan Motor Co., Ltd., Yokohama, Japan

[21] Appl. No.: 312,750

[22] Filed: Sep. 27, 1994

[30] Foreign Application Priority Data

Sep. 28, 1993 [JP] Japan ..... 5-241863

[51] Int. Cl.[6] ..... F02M 33/02

[52] U.S. Cl. ..... 123/520

[58] Field of Search ..... 123/518, 519, 123/520

[56] References Cited

U.S. PATENT DOCUMENTS

| | | | |
|---|---|---|---|
| 4,343,281 | 8/1982 | Uozumi et al. | 123/519 |
| 4,949,695 | 8/1990 | Uranishi et al. | 123/520 |
| 5,191,870 | 3/1993 | Cook | 123/520 |
| 5,193,512 | 3/1993 | Steinbrenner et al. | 123/520 |
| 5,261,379 | 11/1993 | Lipinski et al. | 123/520 |
| 5,263,462 | 11/1993 | Reddy | 123/520 |
| 5,275,144 | 1/1994 | Gross | 123/520 |
| 5,333,589 | 8/1994 | Otsuka | 123/520 |
| 5,333,590 | 8/1994 | Thomson | 123/520 |
| 5,339,788 | 8/1994 | Blumenstock et al. | 123/520 |
| 5,363,828 | 11/1994 | Yamashita et al. | 123/520 |
| 5,383,438 | 1/1995 | Blumenstock | 123/520 |
| 5,398,662 | 3/1995 | Igabashi et al. | 123/520 |

OTHER PUBLICATIONS

"Technical Status Update And Proposed Revisions To Malfunction And Diagnostic System Requirements Applicable To 1994 And Subsequent California Passenger Cars, Light--Duty Trucks, And Medium-Duty Vehicles", Released Jul. 26, 1991, California Air Resources Board.

*Primary Examiner*—Thomas N. Moulis

*Attorney, Agent, or Firm*—Price, Leblanc & Becker Lowe

[57] ABSTRACT

According to a strategy of monitoring an evaporative purge system, a tank pressure within a fuel tank is monitored and a canister purge valve is shut off if the monitored tank pressure reaches a predetermined vacuum. A purge prohibit code is stored after the monitored tank pressure has reached the predetermined vacuum. A canister purge by the engine is conducted if predetermined conditions are met unless the purge prohibit code is stored.

8 Claims, 4 Drawing Sheets

MONITORING OF EVAPORATIVE PURGE SYSTEM

BACKGROUND OF THE INVENTION

The present invention relates to managing an evaporative purge system for a vehicle having a fuel tank connected to an internal combustion engine.

Various techniques for monitoring the evaporative purge system are proposed in U.S. patent application Ser. No. 08/153,516 filed on Nov. 17, 1993, now U.S. Pat. No. 5,408,866, which copending application has been commonly assigned herewith.

It is desirable to be able to repeatedly check the operability of an evaporative purge system since a fuel tank is vented during normal purge operation.

SUMMARY OF THE INVENTION

According to the invention, there is provided an evaporative purge system for an internal combustion engine having an air induction passage, comprising:

a canister having a canister vent valve;

a fuel tank coupled to said canister;

a purge line connected to said canister;

a canister purge valve fluidly connected between said purge line and the air induction passage;

means for monitoring a tank pressure within said fuel tank and generating an output when said tank pressure drops below a predetermined vacuum; and means responsive to said output for shutting off fluid flow communication between the fuel tank and the air induction passage.

According to another aspect of the invention, there is provided a method of monitoring an evaporative purge system having a fuel tank coupled to a canister which is in turn coupled to a purge line connected via a canister purge valve to an air induction passage of an internal combustion engine, the method comprising the steps of:

monitoring a tank pressure within the fuel tank;

repeatedly determining whether said monitored tank pressure reaches a predetermined vacuum and generating an output when said monitored tank pressure reaches said predetermined vacuum; and shutting off fluid flow communication between the fuel tank and the air induction passage in response to said output.

According to a further aspect of the invention, there is provided a method of monitoring an evaporative purge system having a fuel tank coupled to a canister which is in turn coupled to a purge line connected via a canister purge valve to an air induction passage of an internal combustion engine, the method comprising the steps of:

monitoring a tank pressure within the fuel tank;

repeatedly determining whether said monitored tank pressure reaches a predetermined vacuum and generating an output when said monitored tank pressure reaches said predetermined vacuum;

storing a purge prohibit code in response to said output;

keeping the canister purge valve closed to shut off fluid flow communication between the fuel tank and the air induction passage in response to said output until the engine ceases to operate; and conducting a canister purge by the engine during operation of the engine if predetermined conditions are met unless said purge prohibit code is stored.

DETAILED DESCRIPTION OF THE INVENTION

Figure 1:
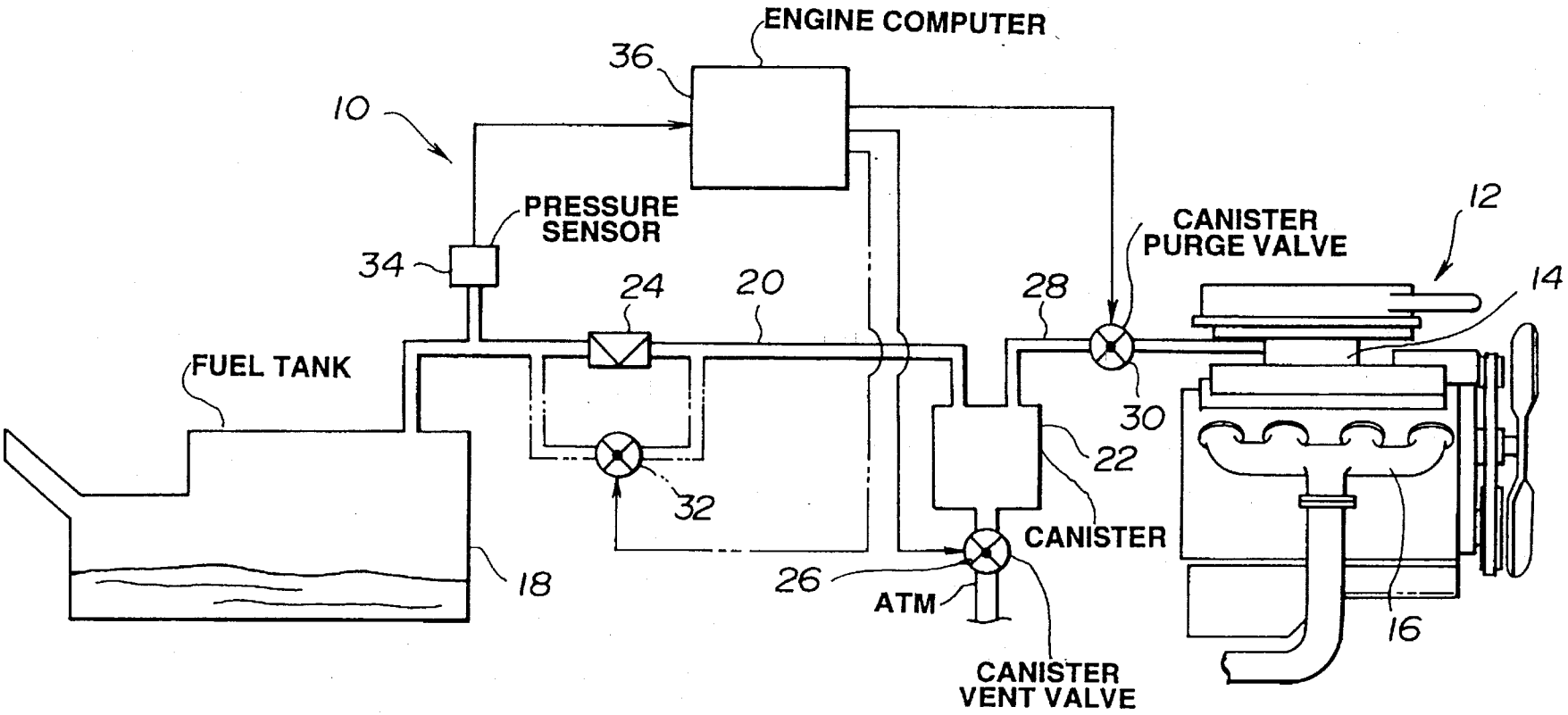
FIG. 1 is a block diagram of an evaporative purge system.

Referring to FIG. 1, an evaporative purge system 10 for an internal combustion engine 12 is shown. The engine 12 has an air induction passage 14 and an exhaust manifold 16. The evaporative purge system 10 includes a fuel tank 18 which is connected to an evaporative fuel line 20 coupled to a charcoal canister 22. One-way check valve 24 is arranged to prevent reverse flow of evaporated fuel. The canister 22, which is connected to the atmosphere through a canister vent valve 26, is coupled to an evaporative purge line 28 connected to the air induction passage 14 of the engine 12 through a canister purge valve 30. If desired, a bypass valve 32 is connected in parallel to the one-way check valve 24.

A pressure sensor 34 is remotely mounted and connected by the evaporative fuel line 20 to the fuel tank 18. The pressure sensor 34 provides a signal indicative of a tank pressure within the fuel tank 18. This signal is fed to an engine computer 36. The engine computer 36 can perform a diagnostic test to determine whether the purge system is leaked or a normal purge operation. Besides, the engine computer 36 can check repeatedly the operability of the canister vent valve 26 and canister purge valve 30 during the operation of the engine 12.

Figure 2:
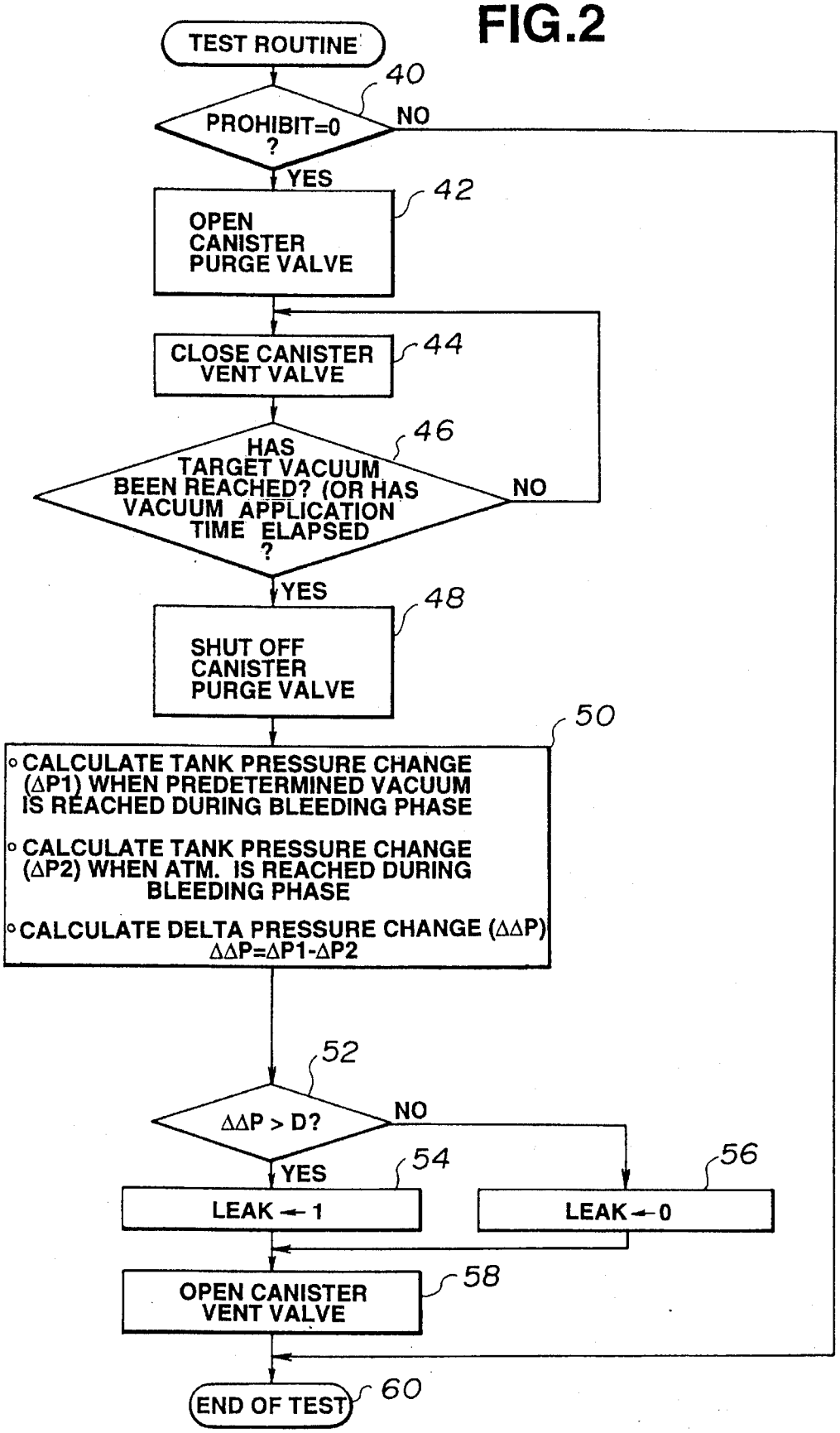
FIG. 2 is a flow diagram of a test routine to determine whether there is any leak in the system.

FIG. 2 is a flow diagram implementating a daignostic test. This test is conducted during an engine operation where predetermined test entry conditions are met. At a block 40 in FIG. 2, there is an interrogation that a flag PROHIBIT is cleared. This flag PROHIBIT is set in a manner which will be later described in connection with FIG. 4.

Assuming that the flag PROHIBIT is cleared, the logic flow goes to a block 42 where the canister purge valve 30 is opened and then to a block 44 where the canister vent valve 26 is closed. Then, a vacuum from the air induction passage 14 begins to be applied to the evaporative purge system 10. The logic flow goes to a block 46 where an interrogation is made whether a target vacuum is reached. This is made by comparing the tank pressure by the pressure sensor 34 with the target vacuum. Alternatively, an elapsed time may be compared with a preset vacuum build time to determine whether the target vacuum has been reached. The logic flow returns to the block 44 to repeat the interrogation at the block 46 until the target vacuum is reached. If the target vacuum builds up in the system, the logic flow goes from the block 46 to a block 48 where the canister purge valve 30 is shut off to isolate the evaporative purge system 10, initiating a bleeding phase. The logic flow goes to a block 50 where a routine to monitor tank pressure is conducted. Simply explaining, the tank pressure detected by the pressure sensor 34 is repeatedly stored at regular intervals to calculate a tank pressure change. The calculated tank pressure change is stored as $\Delta P1$ (delta P1) when a predetermined vacuum is reached, and stored as $\Delta P2$ (delta P2) when atmospheric level is reached. Then, a delta pressure change $\Delta\Delta P$ (delta delta P) is calculated by subtracting $\Delta P2$ (delta P2) from $\Delta P1$ (delta P1). The logic flow then goes to a block where an interrogation is made whether $\Delta\Delta P$ (delta delta P) is greater than a predetermined value D. If this is the case, the logic flow goes to a block 54 where a flag LEAK is set, indicating that there is a leak in the evaporative purge system 10. If not, the logic flow goes from the block 52 to a block 56 where the flag LEAK is cleared indicating that the evaporative purge system 10 is not leaked. After the block 54 or 56, the logic flow goes to a block 58 where the canister vent valve 26 is opened and then to an end block 60. If the interrogation at the block 40 results in negative, the test is not conducted.

Figure 3:
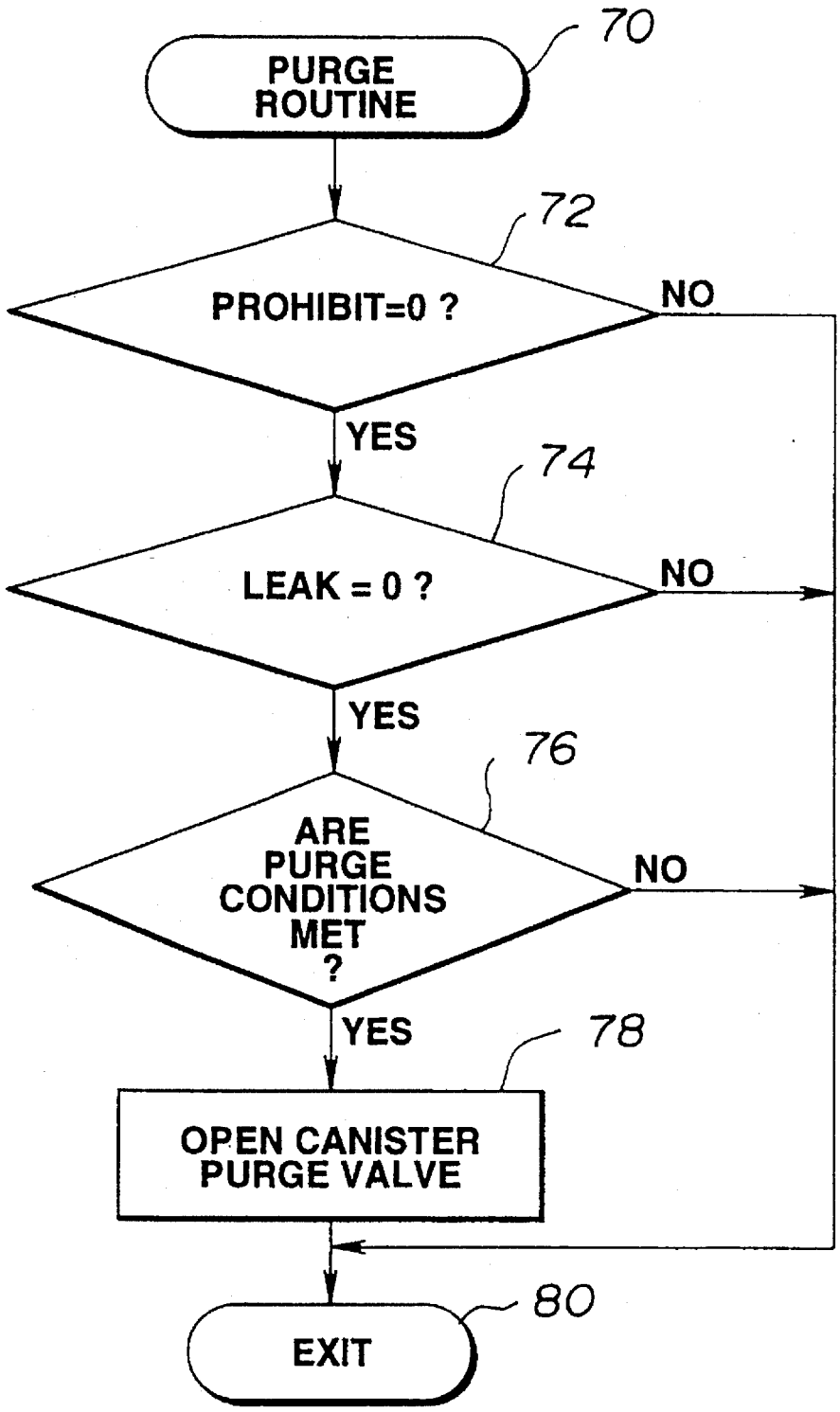
FIG. 3 is a flow diagram of an engine purge routine.

FIG. 3 is a simplified flow diagram of the engine purge operation. Execution of this engine purge routine is repeated at regular intervals. This routine starts at an entry block 70. At a block 72, an interrogation is made whether the flag PROHIBIT is cleared. If the flag PROHIBIT is set, this routine is not conducted so that the engine purge operation is not carried out. If the interrogation at the block 72 results in affirmative, the logic flow goes to a block 74 where an interrogation is made whether the flag LEAK is cleared. If the flag LEAK is cleared, the logic flow goes to a block 76 where an interrogation is made whether purge conditions are met. If the purge conditions are met, the logic flow goes to a block 78 where the canister purge valve 30 is opened to initiate purging of the canister 22. The logic flow then goes to an exit block 80 until the subsequent execution of this routine. The logic flow goes to the block 80 if the flag LEAK is set (see block 74) or the purge conditions are not met (see block 76).

Figure 4:
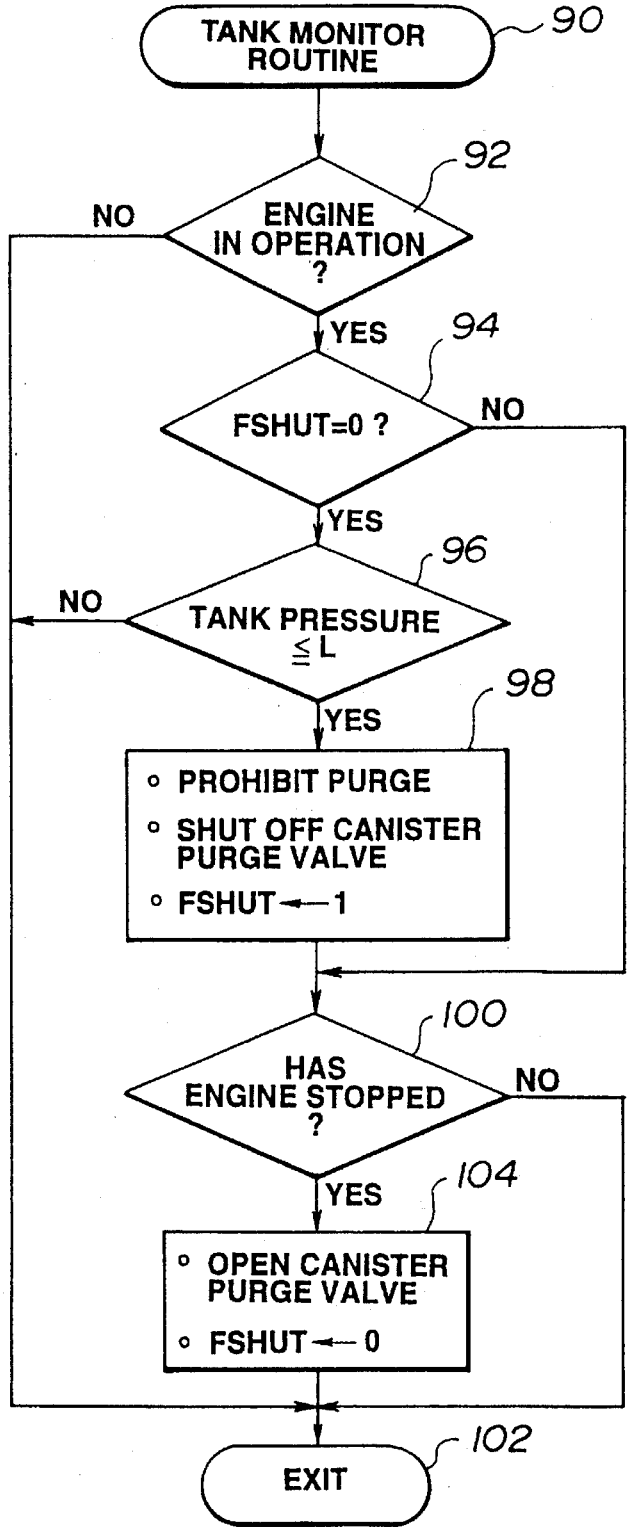
FIG. 4 is a fuel tank monitor routine.

FIG. 4 is a flow diagram of a tank pressure monitor routine to check the operability of the canister vent valve 26 and the canister purge valve 30. Execution of this routine is repeated at regular intervals during the operation of engine. The routine starts at an entry block 90. At a block 92, an interrogation is made whether the engine is in operation. If this is the case, logic flow goes to a block 94 where an interrogation is made whether a flag FSHUT is cleared. If this is the case, the logic flow goes to a block 96 where an interrogation is made whether the detected tank pressure is lower than or equal to a predetermined vacuum L. If this is the case, the logic flow goes to a block 98 where, in order to prohibit purge operation, the flag PROHIBIT is set, the canister purge valve 30 is shut off, and the flag FSHUT is set. The logic flow then goes to a block 100 where an interrogation is made whether the engine has ceased to operate. If this is the case, the logic flow goes to a block 104 where the canister purge valve 30 is opened and the flag FSHUT is cleared and then to an exit block 102.

If, at the block 100, the interrogation results in negative, the logic flow goes to the exit block 102 and then returns to the block 100 again since, in the next run, the logic flow goes through the block 90, 92 and 94 to the block 100 passing the blocks 96 and 98. This means that once it is set at the block 98, the flag PROHIBIT is kept set thereafter. It is seen that the logic flow goes from the block 92 to the exit block 102 if the engine is not in operation. It is also seen that the logic flow goes from the block 96.

The flag PROHIBIT should be cleared after the system 10 is repaired. Thus, it is desirable to inform a driver of a motor vehicle that the evaporative purge system 10 needs repair if the flag PROHIBIT is set.

What is claimed is:

1. An evaporative purge system for an internal combustion engine having an air induction passage, comprising:

a canister having a canister vent valve;

a fuel tank coupled to said canister;

a purge line connected to said canister;

a canister purge valve fluidly connected between said purge line and the air induction passage;

means for monitoring a tank pressure within said fuel tank when the internal combustion engine operates and generating an output when said tank pressure drops below a predetermined vacuum;

means responsive to said output for closing said canister purge valve to shut off fluid flow communication between the fuel tank and the air induction passage; and means for opening said canister purge valve when subsequently the engine ceases to operate.

2. An evaporative purge system as claimed in claim 1, wherein said monitoring means includes a pressure sensor mounted to said fuel tank.

3. An evaporative purge system for an internal combustion engine having an air induction passage, comprising:

a canister having a canister vent valve;

a fuel tank coupled to said canister;

a purge line connected to said canister;

a canister purge valve fluidly connected between said purge line and the air induction passage;

means for monitoring a tank pressure within said fuel tank when the internal combustion engine operates and generating an output when said tank pressure drops below a predetermined vacuum; and means responsive to said output for keeping said canister purge valve closed to shut off fluid flow communication between the fuel tank and the air induction passage until the engine ceases to operate and for opening said canister purge valve when subsequently the engine ceases to operate.

4. A method of monitoring an evaporative purge system having a fuel tank coupled to a canister which is in turn coupled to a purge line connected via a canister purge valve to an air induction passage of an internal combustion engine, the method comprising the steps of:

monitoring a tank pressure within the fuel tank when the internal combustion engine operates;

repeatedly determining whether said monitored tank pressure reaches a predetermined vacuum and generating an output when said monitored tank pressure reaches said predetermined vacuum;

closing the canister purge valve to shut off fluid flow communication between the fuel tank and the air induction passage in response to said output; and opening the canister purge valve when subsequently the engine ceases to operate.

5. A method of monitoring an evaporative purge system having a fuel tank coupled to a canister which is in turn coupled to a purge line connected via a canister purge valve to an air induction passage of an internal combustion engine, the method comprising the steps of:

monitoring a tank pressure within the fuel tank when the internal combustion engine operates;

repeatedly determining whether said monitored tank pressure reaches a predetermined vacuum and generating an output when said monitored tank pressure reaches said predetermined vacuum;

keeping the canister purge valve closed to shut off fluid flow communication between the fuel tank and the air induction passage in response to said output until the engine ceases to operate; and opening the canister purge valve when subsequently the engine ceases to operate.

6. A method of monitoring an evaporative purge system having a fuel tank coupled to a canister which is in turn coupled to a purge line connected via a canister purge valve to an air induction passage of an internal combustion engine, the method comprising the steps of:

monitoring a tank pressure within the fuel tank when the internal combustion engine operates;

repeatedly determining whether said monitored tank pressure reaches a predetermined vacuum and generating an output when said monitored tank pressure reaches said predetermined vacuum;

storing a purge prohibit code in response to said output;

keeping the canister purge valve closed to shut off fluid flow communication between the fuel tank and the air induction passage in response to said output until the engine ceases to operate;

conducting a canister purge by the engine when the engine operates if predetermined conditions are met unless said purge prohibit code is stored; and opening the canister purge valve when subsequently the engine ceases to operate.

7. A method of monitoring an evaporative purge system having a fuel tank coupled to a canister which is in turn coupled to a purge line connected via a canister purge valve to an air induction passage of an internal combustion engine, the method comprising the steps of:

monitoring a tank pressure within the fuel tank when the internal combustion engine operates;

repeatedly determining whether said monitored tank pressure reaches a predetermined vacuum and generating an output when said monitored tank pressure reaches said predetermined vacuum;

storing a purge prohibit code in response to said output;

keeping the canister purge valve closed to shut off fluid flow communication between the fuel tank and the air induction passage in response to said output until the engine ceases to operate;

conducting a test of the purge system by applying vacuum from the air induction passage unless said purge prohibit code is stored; and opening the canister purge valve when subsequently the engine ceases to operate.

8. An evaporative purge system for an internal combustion engine having an air induction passage, comprising:

a canister having a canister vent valve;

a fuel tank coupled to said canister;

a purge line connected to said canister;

a canister purge valve fluidly connected between said purge line and the air induction passage;

a pressure sensor mounted to monitor a tank pressure within said fuel tank when the internal combustion engine operates and generating a sensor signal indicative of the monitored tank pressure; and means coupled with said pressure sensor, said means being operative to generate an output when said sensor signal indicates a tank pressure below a predetermined vacuum, said means being operative to close said canister purge valve to shut off fluid flow communication between the fuel tank and the air induction passage in response to the presence of said output, said means being operative to open said canister purge valve when subsequently the engine ceases to operate.

* * * * *